United States Patent [19]

Douglas

[11] 3,935,641

[45] Feb. 3, 1976

[54] ADJUSTABLE DRAWING SWEEP

[76] Inventor: Thomas P. Douglas, 2877 E. Fairmount, Phoenix, Ariz. 85016

[22] Filed: Oct. 29, 1974

[21] Appl. No.: 518,600

[52] U.S. Cl. ..... 33/177

[51] Int. Cl.[2] ..... B43L 13/22

[58] Field of Search ..... 33/177, 174 G

[56] References Cited

UNITED STATES PATENTS

| | | | |
|---|---|---|---|
| 583,858 | 6/1897 | Follett | 33/177 |
| 1,443,877 | 1/1923 | Guelbaum | 33/177 |
| 3,299,519 | 1/1967 | Toth | 33/177 |
| 3,388,475 | 6/1968 | Yoshioka | 33/177 |

FOREIGN PATENTS OR APPLICATIONS

| | | | |
|---|---|---|---|
| 5,435 | 1/1896 | United Kingdom | 33/177 |

*Primary Examiner*—William D. Martin, Jr.
*Assistant Examiner*—Richard R. Stearns
*Attorney, Agent, or Firm*—H. Gordon Shields

[57] ABSTRACT

Adjustable drawing sweep apparatus is disclosed which includes a flexible sweep pivotally secured to one end of a base member and extending to an adjustable lever secured to the opposite end of the base member. The lever includes a plurality of notches into which the flexible sweep may be disposed and it also includes adjustment means for pivoting the lever with respect to the base and to the flexible sweep member.

2 Claims, 7 Drawing Figures

ADJUSTABLE DRAWING SWEEP

BACKGROUND OF THE INVENTION

1. Field of the Invention

This invention relates to drawing apparatus, and more particularly, to an adjustable drawing sweep used to draw a curve through a plurality of points.

2. Description of the Prior Art

In drawing, there are basically two kinds of lines, straight lines and curved lines. In the drawing of the curved lines, there are several ways of connecting points which define or describe a curve, using the so-called French curve. The French curve is not adjustable, and accordingly the curve defined by a plurality of points is approximately connected by fitting an appropriate French curve to the point or as close to the points as possible. Since there are so many different types of French curves available, the process of drawing a curve by connecting appropriate points can be accomplished with a substantial degree of accuracy. However, for curves of 2 or 3 feet in length, it becomes an extremely formidable task to construct a curve through a plurality of points. To enhance the drawing of such curves, larger apparatus, generally termed sweeps, are employed.

The Toth U.S. Pat. No. 3,299,519, issued Jan. 24, 1967, is typical of the prior art. The Toth patent includes a bow, or flexible sweep member, extending generally from one side of the base of the apparatus to a notch, or rather, selectively, to a plurality of notches, in the opposite side of the base. To vary the extent of the curve of the flexible sweep member, the tip of the flexible member is inserted into one of the plurality of notches in the opposite end of the base member. Since there is no degree of flexibility other than as provided by the plurality of notches, the resulting curve defined by a plurality of points may or may not be accurate.

Other design apparatus of the prior art includes a flexible member movable on a fixed member, such as a ruler, as shown in the Marshall U.S. Pat. No. 199,917, issued Feb. 5, 1878.

The Toquet patent is in principle similar to the Marshall patent, except that a flexible string is used to vary the curvature of the sweep or bow. The Toquet U.S. Pat. No. 412,904, was issued on Oct. 15, 1889.

The above described three patents are typical of the prior art and each have their limitations, such as ease of adjustability, degree or extent of adjustability, and ease of use. While the small fixed French curves are extensively used for small designs and curves, for drawing curved lines of large items, such as ships, aircraft, and automobiles, a large adjustable drawing template or sweep is required.

SUMMARY OF THE INVENTION

The adjustable sweep apparatus described and claimed herein includes a base member with an adjustable sweep member pivotally secured to one end thereof and freely movable at its opposite end into any one of a plurality of notches in a lever pivotally secured to the base member at the opposite end from which the adjustable member is pivotally secured. The lever is adjustable to vary the curve of the adjustable sweep member in addition to the curve imparted in the adjustable member by the various notches on the lever.

Among the objects of the present invention are the following:

To provide new and useful adjustable sweep apparatus;

To provide new and useful apparatus for drawing a curved line;

To provide new and useful drawing apparatus including a member adjustable to describe a curve defined by a plurality of points; and To provide new and useful adjustable sweep apparatus having a flexible member pivotally secured at one end and adjustably secured at its opposite end.

DESCRIPTION OF THE PREFERRED EMBODIMENT

Figures 1, 2, 3, 4, 5, 6, 7:
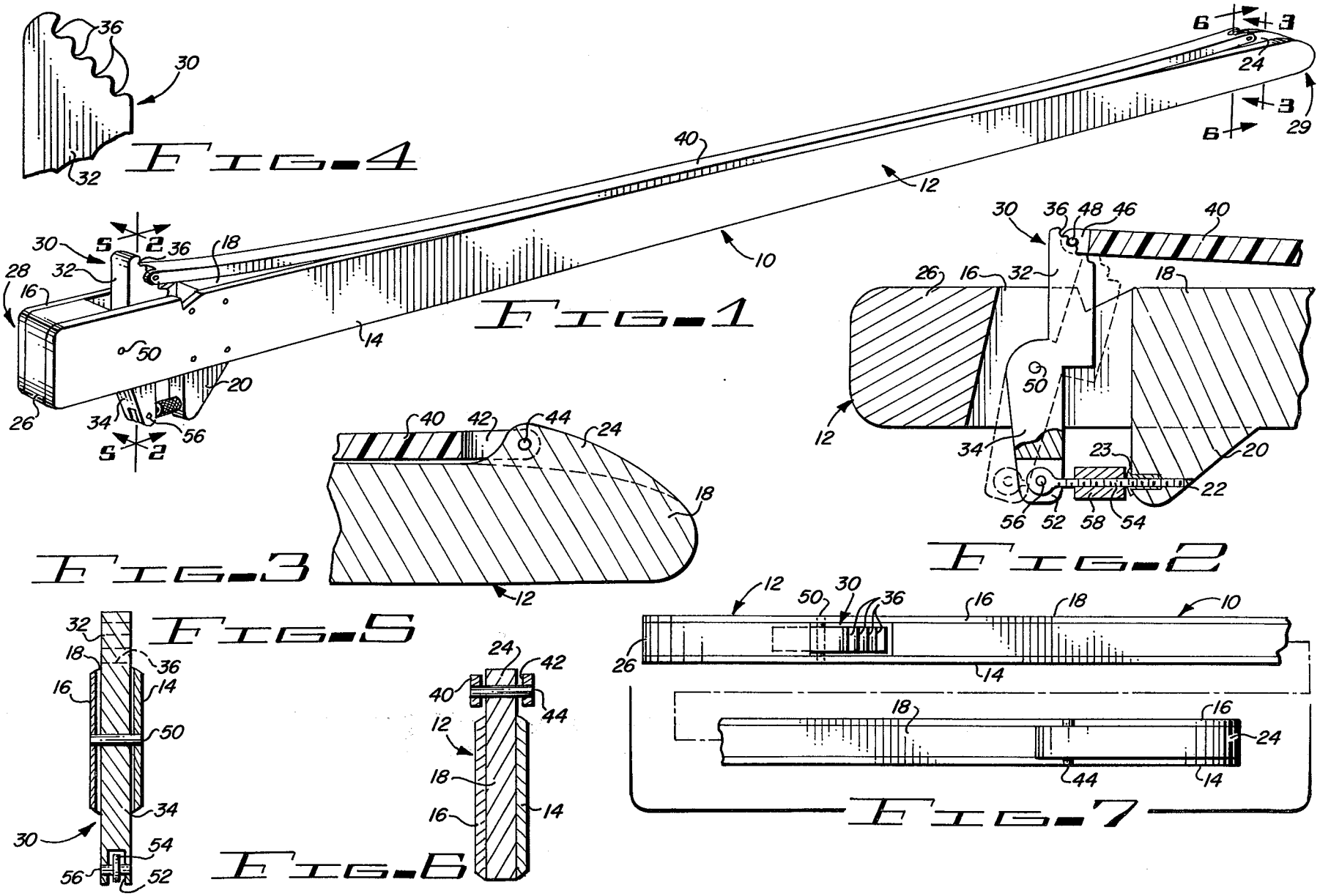
FIG. 1 is a perspective view of apparatus embodying the present invention.
FIG. 2 is a view in partial section of a portion of the apparatus of FIG. 1 taken generally along line 2—2 of FIG. 1.
FIG. 3 is a view of a portion of the apparatus of FIG. 1, in partial section, taken generally along line 3—3 of FIG. 1.
FIG. 4 is a fragmentary side view of a portion of the apparatus of FIG. 1.
FIG. 5 is a view in partial section of the apparatus of FIG. 1 taken generally along line 5—5 of FIG. 1.
FIG. 6 is a view in partial section of the apparatus of FIG. 1 taken generally along line 6—6 of FIG. 1.
FIG. 7 is a top view of the apparatus of FIG. 1.

FIG. 1 is a perspective view of adjustable sweep apparatus 10 embodying the present invention. The apparatus 10 includes a base member 12 and a flexible bow or sweep member 40 secured thereto. The base member 12 includes a pair of side members 14 and 16 and a center spacer 18 secured to and disposed between the sides. In addition to the center spacer 18, there is an end spacer 26 which is substantially the same width as the center spacer 18, but spaced apart slightly from the center spacer adjacent one end 28 of the apparatus 10. Between the spacer 18 and the end spacer 26 and between the sides 14 and 16 is disposed a lever 30. The lever 30 is pivotally secured to the body 12 as by a pin 50 which extends through the sides 14 and 16 and of course through the lever 30. The lever 30 includes an upwardly extending portion 32 which extends upwardly generally above the body or base 12, and it also includes a depending portion 34 which extends below the base or body 12. The extending portion 32 of the lever 30 includes a plurality of notches 36.

The sweep 40 is pinned at an end 29 of the base 12 to an extending portion 24 of the spacer 18. The end 29 of the base is remote from end 28. The other end, the free end, of the sweep 40 may be selectively placed in any of the notches 36 on the lever 30. The lever 30 is movable in response to the bias of the sweep 40 and also in response to the limitation of motion placed thereon by a threaded rod and nut which extends between the depending portion 20 of spacer 18 and the depending portion 34 of the lever. The threaded rod and nut is pinned by a pin 56 to the depending portion 34 and extends from there into an aperture in the depending portion 20 of spacer 18. This feature will be discussed in detail below.

FIG. 2 is a view in partial section of a portion of the apparatus of FIG. 1 taken generally along line 2—2 of FIG. 1. The view in FIG. 2 is that of the end of the adjustable sweep apparatus 10 of FIG. 1 opposite that end at which the sweep 40 is secured to the base 12. The view in FIG. 2 accordingly includes spacer 18, one side 16, and end spacer 26. The lever 30 extends between the spacers 18 and 26 and is pinned by a pin 50 to the side 16 and also to sides 14, as illustrated in FIG. 1 and as shown in more detail in FIG. 5.

The lever 30 includes two portions offset from each other, extending portion 32 which extends upwardly from the base 12 and which includes the plurality of notches 36, and depending portion 34, which extends below the base 12. The pin 50 extends through the upper part of the depending portion 34, adjacent the location at which the upper or extending portion 32 connects with the lower or depending portion 34. The lever 32 pivots freely on pin 50 between the spacers 18 and 26 in response to the bias of sweep 40 as limited by a threaded rod and nut adjustment means.

At the lower or bottom end of depending portion 34 of lever 30 is a groove 52. A threaded rod 54 is pivotally secured to the depending portion 34 in the groove 52 and is secured therein by a pin 56. The free end of the threaded rod 54 extends into a bore or aperture 22 in the depending portion 20 of spacer 18. The rod 54 extends through a bushing 23 disposed in the aperture or bore 22. A nut 58 is threadedly secured to the rod 54 between the lever 30 and the depending portion 20 of spacer 18. By adjusting the nut 54, the lever 30 may be moved with or against the bias of the sweep 40. As the lever 30 is moved, the sweep 40, which is flexible, of its inherent resiliency moves to either increase or decrease its radius of curvature. The radius of curvature is also changed by placing the sweep in various notches 36.

The free end of the sweep 40 includes a groove or notch 46, and a pin 48 extends between the sides of the sweep 40 through the groove or notch 46. The width of sweep 40 is substantially the same width as the base 12, including the spacer 18 and the pair of sides 14 and 16. Since the lever 32 extends between the sides 14 and 16 and moves freely therebetween, its width is less than the total width of the base, and is slightly less than the width of spacer 18 in order to allow the lever to move freely on its pin between the sides. Accordingly, the width of notch or groove 46 is slightly larger than the width of the lever 30 in order to allow the pin 48 to be freely disposed in any of the notches 36.

FIG. 3 is a view in partial section of a portion of the apparatus of FIG. 1 taken generally along line 3—3 of FIG. 1, and illustrating the pivotal connection of the sweep 40 and the base 12. Spacer 18 includes an upwardly extending portion 24 at the end 29 of the spacer and the base 12. The end 29 is opposite or remote from the end 28, adjacent which the lever 30 is disposed. Sweep 40 includes a notch 42, similar to notch 46, and a pin 44 extending across the notch 42 and through the upwardly extending portion 24 of the spacer 18. Again, the width of the sweep 40 is substantially the same width as the total width of the base 12, including spacer 18 and the sides. Notch 42 is of sufficient width to accommodate the upwardly extending portion 24 of the spacer 18 therein. The pin 44 accordingly extends through the spacer 18, and through the sweep 40 across the groove or notch 42 to pivotally connect the sweep to the base 12.

FIG. 4 is a fragmentary view of a portion of the lever 30. The upper or extending portion 32 of the lever 30 is shown with a plurality of notches 36 extending adjacent each other in the top part of the upwardly extending portion 32. With each of the notches 36 staggered or offset from the next adjacent notch, each notch provides a different radius of curvature for the sweep 40. Moreover, since the lever 30 is also movable, a wide variety of radii of curvature are possible. Obviously, the length of the apparatus, and the length of the sweep 40, are of substantial importance in determining an actual radius of curvature. The overall length of the apparatus may vary, depending upon the various design parameters for which the adjustable sweep apparatus will be used.

FIG. 5 is a view in partial section of a portion of the apparatus of FIG. 1 taken generally along line 5—5 of FIG. 1. The view is looking along the sweep apparatus through lever 30 and base 12. The base 12 is shown in section through sides 14 and 16. Spacer 18 is shown disposed between the sides 14 and 16.

The lever 30 is also shown in section, with the extending portion 32 and the depending portion 34 disposed respectively upwardly and downwardly with respect to the base 12. The lever 30 is shown with pin 50 secured therethrough and through the walls 14 and 16.

At the lower or bottom end of the depending portion 34 of the lever 30 is a notch or groove 52. Threaded rod 54 is disposed within the groove 52 and is secured in place within the groove by a pin 56. The pin is in turn secured to the lever 30. The threaded rod 54 is narrower than the width of the groove 52 and is accordingly movable or pivotable on the pin 56. The notches 36 are shown in phantom at the upper or top end of the upwardly extending portion 32 of the lever 30.

FIG. 6 is a view in partial section of the apparatus of FIG. 1 taken generally along line 6—6 of FIG. 1 and illustrating the pivoting connection between the sweep 40 and the base 12. The sides 14 and 16 are shown secured to, and disposed on either side of, spacer 18. The spacer 18 includes an upwardly extending portion 24 which extends above the sides 14 and 16.

The sweep 40 includes a notch or groove 42 which receives the upwardly extending portion 24 of the spacer 18. The width of the groove 42 is greater than the width of the spacer 18. A pin 44 extends through the spacer 18 and is secured across the groove 42 of the sweep 40 to provide a movable or pivotable connection between the sweep 40 and the base 12. The sweep 40 is accordingly secured at its one end to the base 12, as shown in FIG. 6, and is adjustable at its opposite end to an appropriate position in any one of the notches 36 of the lever 30. (See FIGS. 1, 2, and 4.)

FIG. 7 is a vertical view, broken for convenience of illustrating the entire apparatus within the limitation of the space provided on the drawing. The top view of the adjustable sweep apparatus 10 shows the base 12 which includes a side 14, a side 16, and a spacer 18 disposed therebetween. At opposite ends of the apparatus is the upwardly extending portion 24 of the spacer 18 and the end spacer 26. Between the end spacer 26 and the spacer 18 is the lever 30. The lever 30 is secured between the sides 14 and 16 by a pin 50 which extends through the lever 30 and into, or through, the sides 14 and 16.

The lever 30 pivots about the pin 50 in response to movement of a nut secured to a threaded rod extending between the lever and a downwardly depending portion of the spacer 18. (See FIGS. 1, 2, and 5.) The lever 30 includes the plurality of notches 36, each of which is set back or offset from the next adjacent notch with respect to the upwardly extending portion 24 of the base 12. The notches provide a different radius of curvature for the sweep from its pivot point on the upwardly extending portion 24 of the spacer 18.

The sweep is connected to the upwardly extending portion 24 of the spacer 18 by a pin 44 which is secured through the spacer 18 and extends outwardly therefrom and through the sweep. (See FIGS. 3 and 6.)

The bow or sweep is made of a flexible material, preferably a transparent polymeric substance, such as methyl methacrylate. The base of the apparatus may be made of non-warping material, such as different kinds of wood for the spacer and for the sides. By laminating the spacer and the sides, the base may be fabricated that will be non-warping regardless of the length of the base, within reason and within the limits of practicality. The pins, fastening means, threaded rod, etc., are all well known in the art, and may be of a number of appropriate types and may be fabricated from any appropriate material.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Adjustable drawing sweep apparatus, comprising, in combination:

a base member;

a flexible sweep member including a free end and a pinned end pivotally secured to one end of the base member;

a lever pivotally secured to the base member adjacent another end of the base member;

a plurality of notches on the lever for receiving the free end of the sweep member, each notch of which is offset from an adjacent notch to provide a plurality of radii of curvature for the sweep member; and means for adjusting the lever with respect to the base member to vary the radius of curvature of the sweep member.

2. The apparatus of claim 1 in which the means for adjusting the lever includes a threaded rod extending between and connected to one of the lever or the base member and movable relative to the other of the lever or the base member and further includes a nut threadedly secured to the threaded rod for moving the lever with respect to the base in response to adjustment of the nut on the threaded rod.

* * * * *